United States Patent [19]

Holmes et al.

[11] 4,379,799

[45] Apr. 12, 1983

[54] NONWOVEN FABRIC HAVING THE APPEARANCE OF APERTURED, RIBBED TERRY CLOTH

[75] Inventors: Rory A. Holmes, Kendall Park; Donald V. Skistimas, Milltown, both of N.J.

[73] Assignee: Chicopee, New Brunswick, N.J.

[21] Appl. No.: 236,401

[22] Filed: Feb. 20, 1981

[51] Int. Cl.[3] ..... D04H 3/08; D06C 1/06

[52] U.S. Cl. ..... 428/131; 428/296

[58] Field of Search ..... 428/131, 296

[56] References Cited

U.S. PATENT DOCUMENTS

| | | | |
|---|---|---|---|
| 3,353,225 | 11/1967 | Dodson | 428/131 |
| 3,485,706 | 12/1969 | Evans | 428/131 |
| 3,493,462 | 2/1970 | Bunting | 428/131 |

*Primary Examiner*—Marion McCamish

*Attorney, Agent, or Firm*—Nancy A. Bird; Charles J. Metz

[57] ABSTRACT

A nonwoven fabric which has the appearance of apertured, ribbed terry cloth is produced by fluid entangling of fibers on a special forming belt.

3 Claims, 30 Drawing Figures

NONWOVEN FABRIC HAVING THE APPEARANCE OF APERTURED, RIBBED TERRY CLOTH

The invention relates to a nonwoven fabric that has the appearance of apertured, ribbed terry cloth, and to a process and apparatus for producing it.

BACKGROUND OF THE INVENTION

The fluid rearrangement and entangling of fibers to produce nonwoven fabrics has been commercially practiced for many years. See for instance, Kalwaites, U.S. Pat. Nos. 2,862,251 and 3,033,721; Griswold et al., U.S. Pat. No. 3,081,500; Evans, U.S. Pat. No. 3,485,706; and Bunting et al., U.S. Pat. No. 3,493,462. This basic technology has been used to produce a wide variety of nonwoven fabrics. The present invention utilizes fluid rearrangement and entanglement to provide a novel nonwoven fabric having the appearance of ribbed terry cloth, by carrying out the fluid rearrangement/entanglement on a particular type of carrier belt.

SUMMARY OF THE INVENTION

The nonwoven fabric provided by the invention is characterized by a repeating pattern of spaced, parallel, raised ribs which extend continuously in one fabric direction, with the ribs being interconnected by spaced bundles of straight, substantially parallel fiber segments, with said bundles being substantially parallel to one another and substantially perpendicular to said ribs. Adjacent bundles and the ribs they interconnect form apertures. The fibers in the ribs are almost wholly entangled throughout. On the macroscopic scale when viewing the fabric as a whole, the ribs are uniform and substantially non-patterned.

The fabric of the invention is produced by a process which comprises:

(a) supporting a layer of fibrous starting material whose individual fibers are in mechanical engagement with one another but which are capable of movement under applied liquid forces, on a liquid pervious support member adapted to move in a predetermined direction and on which fiber movement in directions both in and at an angle to the plane of said layer is permitted in response to applied liquid forces, said support member having alternating liquid impervious deflecting zones and liquid pervious entangling zones extending transversely to said predetermined direction, said deflecting zones including spaced deflecting means adapted to deflect liquid in a direction transverse to said predetermined direction;

(b) moving the supported layer in said predetermined direction through a fiber rearranging zone within which streams of high pressure, fine, essentially columnar jets of liquid are projected directly onto said layer; and (c) passing said stream of liquid through said layer and said support member in said fiber rearranging zone to effect movement of fibers such that (1) spaced bundles of straight, substantially parallel fiber segments are formed in said deflecting zones, said bundles being oriented generally in said predetermined direction, (2) spaced, parallel ribs are formed in said entangling zones, said ribs extending in a direction transverse to said predetermined direction, and said ribs comprising entangled fibers that are substantially wholly entangled throughout said ribs, and (3) said spaced bundles interconnect said ribs and are locked into said ribs at the ends of said bundles by fiber entanglement.

The apparatus for producing the fabric of the invention comprises:

(a) liquid pervious forming means for supporting a layer of fibrous starting material whose individual fibers are in mechanical engagement with one another but which are capable of movement under applied liquid forces;

(b) means for projecting streams of high pressure, fine, essentially columnar jets of liquid; and (c) means for passing said layer of fibrous starting material directly under said streams while said layer is supported on said liquid pervious forming means, wherein said liquid pervious forming means comprises a woven belt having first fine threads in one fabric direction, and heavier threads and second fine threads in the other fabric direction, the belt having a topography such that there are raised parallel ridges alternating with depressions, wherein each raised ridge comprises one of said heavier threads, wherein said first fine threads pass over said heavier threads at spaced intervals, and wherein said depressions include said first fine threads interlaced with said second fine threads. The belt is relatively tightly woven so that the fibers in said layer will not tend to wash through the belt and so that the ribs which form in the depressions are non-apertured and, at least macroscopically, are substantially uniform and substantially non-patterned.

THE PRIOR ART

In Evans et al., U.S. Pat. No. 3,498,874, there is disclosed entangled nonwoven fabrics produced by fluid rearrangement/entanglement on a woven carrier belt having heavier wires in one direction and three to five times as many finer wires in the other direction. The fabrics produced by Evans et al. bear a certain resemblance to the fabrics of this invention, but differ therefrom in at least the following respects (a) The ribs of the fabrics of this invention appear macroscopically to be uniform and non-patterned. This does not appear to be the case with the majority of the Evans et al. fabrics, as evidenced by FIGS. 19, 20, and 30 of Evans et al. The fabrics shown in these photographs appear to have the fiber bands "cut into" by the apertures between the connecting bundles of fibers, which gives the longitudinal edges of the bands a serrated effect. FIG. 5 of Evans et al. shows a fabric wherein the fiber bands may appear macroscopically to be uniform (it is difficult to determine this feature from this photograph), but the photomacrographs of the fabric of FIG. 5, shown in Evans et al. as FIGS. 6 and 8, show the fiber bands to have a definite and conspicuous patterned appearance;

(b) The ribs of the fabric of this invention are almost wholly entangled, whereas the bands of the Evans et al. fabric contain an interstitial array of generally parallelized (i.e. unentangled) fibers; and (c) The interconnecting bundles of fibers in the fabric of this invention are straight and are almost wholly unentangled. Many of the interconnecting bundles in the Evans et al. fabric are curved (e.g., see FIGS. 6–11, and 14–18), and in some of the other Evans et al. fabrics the interconnecting bundles appear to contain substantial fiber entanglement (e.g., see FIGS. 21, 27, 29, and 31–35). There are some of the Evans et al. fabrics wherein the interconnecting bundles seem to be straight and substantially unentangled (e.g., FIG. 23), but with those fabrics there are other substantial contrasting characteristics when compared with the fabrics of this invention.

Evans et al., in U.S. Pat. No. 3,468,168, disclose nonwoven fabrics produced by rearranging/entangling fibers on a patterning member having a topography of parallel ridges alternating with depressions.

BRIEF DESCRIPTION OF THE DRAWINGS

FIG. 3—a view of the top side, illuminated from below;

FIG. 4—a view of the belt side, illuminated from below, and focused on the interconnecting bundles;

FIG. 5—a view similar to FIG. 4, but focused on the ribs;

FIG. 6—a view of the top side, illuminated from the top; and

FIG. 7—a view of the belt side, illuminated from the top.

FIG. 9—a view of the top side, illuminated from below;

FIG. 10—a view of the belt side, illuminated from below, and focused on the interconnecting bundles;

FIG. 11—a view of the belt side, illuminated from below, and focused on the ribs;

FIG. 12—a view of the top side, illuminated from above; and

FIG. 13—a view of the belt side, illuminated from above.

FIG. 20—A view of the belt side, illuminated from below;

FIG. 21—A view of the top side, illuminated from below; and

FIG. 22—A view of the belt side, illuminated from below.

FIG. 24—A view of the belt side illuminated from above;

FIG. 25—A view of the top side, illuminated from below; and

FIG. 26—A view of the belt side, illuminated from below.

FIG. 28—A view of the belt side, illuminated from above;

FIG. 29—A view of the top side, illuminated from below; and

FIG. 30—A view of the belt side, illuminated from below.

DETAILED DESCRIPTION OF THE INVENTION

Figure 1:
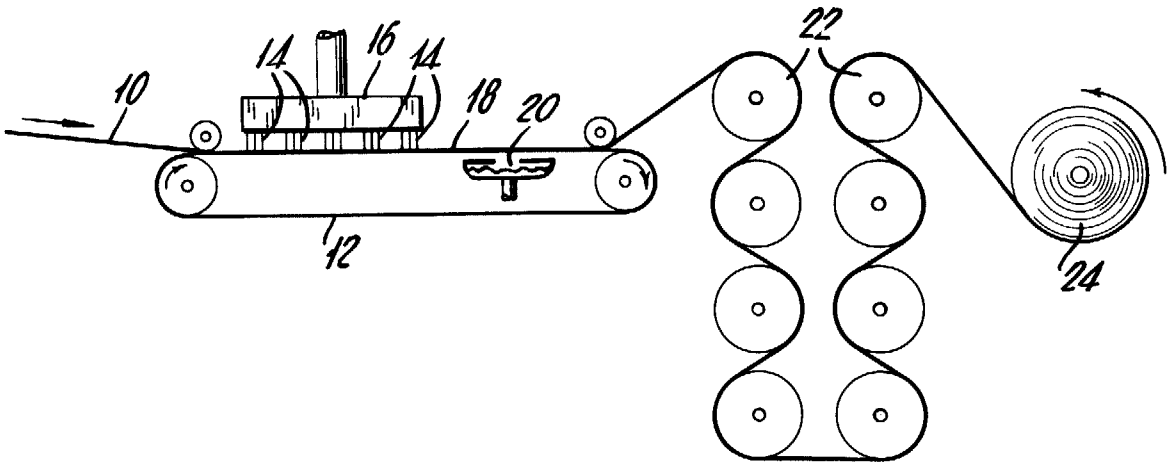
FIG. 1 is a schematic side elevation of an arrangement of apparatus that can be used to carry out the process of the invention.

The nonwoven fabric of this invention is produced by the fluid rearrangement/entanglement of a web comprising a loose array of fibers, on a liquid pervious woven forming belt of special construction which is described fully construction which is described fully below. For instance referring first to FIG. 1 a carded or randon laid web 10 of staple fibers can be passed onto an endless belt 12, which is the said woven forming belt. The belt 12 carries the web of fibers 10 under a series of high pressure fine, essentially columnar jets of water 14. The high pressure water is supplied from a manifold 16. The jets 14 are arranged in rows disposed transversely across the path of travel of the forming belt 12. Preferably, there is a vacuum slot (not shown) pulling a vacuum of, e.g., 5 to 15 inches of mercury, beneath the forming belt 12, directly under each row of jets 14, in order to optimize durability of the fabric product. The fibers in the web 10 are rearranged and entangled by the jets 14 as the liquid from the jets 14 passes through the fibrous web 10 and then through the belt 12, to form the fabric 18 of the invention. The fabric 18 is carried by the belt 12 over a vacuum dewatering station 20, and then proceeds to a series of drying cans 22, and from there to a windup 24.

Evans, in U.S. Pat. No. 3,485,706, describes a process and apparatus for rearranging/entangling fibrous webs by carrying such webs on a woven belt under a series of high pressure, fine, columnar jets of liquid. The disclosure of Evans of incorporated herein by reference.

The invention can use a wide variety of staple fibers, including rayon, polyester, nylon, polypropylene, bicomponent fibers, cotton, and the like, including mixtures thereof. Staple fibers are used, that is, fibers having lengths of up to about three inches. The belt speeds, water jet pressures, and number of rows of jets have not been found to be narrowly critical. Representative conditions are the following:

Belt speed: about 30 to 300 feet/minute
Jet pressure: about 500 to 2000 psi
Rows of jets: about 12 to 100

Carded or random laid webs can be used. Typical web weights are from about 1½ to about 6 ounces per square yard.

As a general rule the heavier webs use slower belt speed and/or higher jet pressure and/or more rows of jets. Also, in order to achieve maximum durability of the heavier fabrics (e.g., fabrics weighing about 3 ounces or more per square yard), sequential entangling is often desirable.

"Sequential entangling" refers to the practice of first rearranging/entangling a web having a basis weight of a fraction (e.g., about one-half) of that of the final product, and without removing the rearranged/entangled web from the forming belt, adding another web of fibers on top of the first and subjecting the combined layers to the rearranging/entangling step. Sequential entangling is illustrated in the examples.

Figure 14:
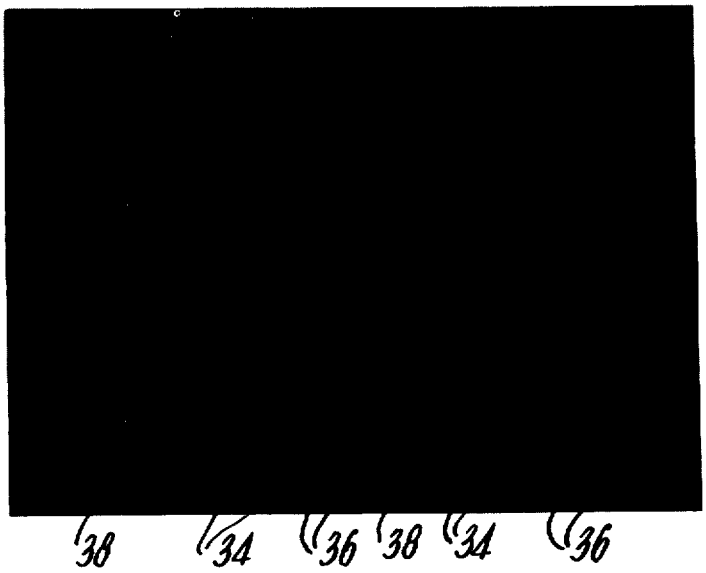
FIGS. 14 and 15 are photomacrographs of the top and bottom sides of the forming or carrier belt used in producing the fabric of Example 2.
Figure 15:
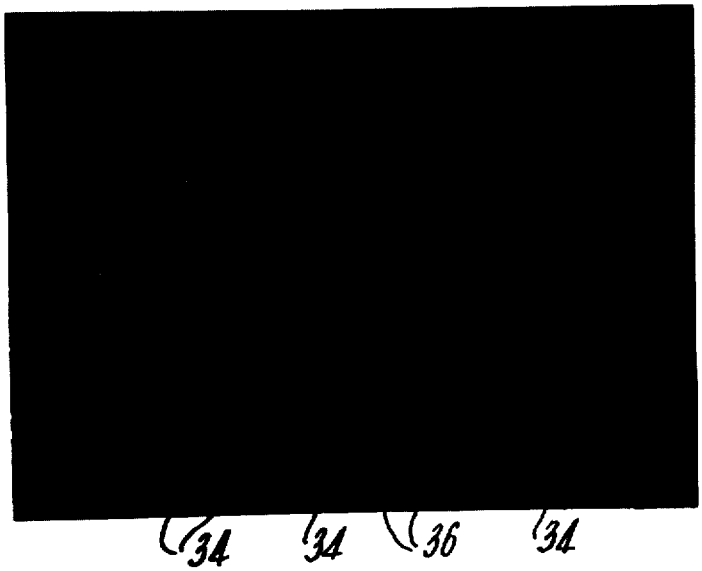

The principal novelty in the process and apparatus of the invention resides in the use of the special forming belt. An illustration of such a belt is shown in FIGS. 14 and 15. The belt is woven from fine warp monofilaments 36, which extend in the direction of travel of the belt, and fill monofilaments of two different sizes, a heavier fill monofilament 38 and finer fill monofilaments 34. The belt is woven in such a manner that the topography of the top surface of the belt, that is, the surface which the fibers will contact, has raised parallel ridges alternating with depressions. The raised ridges are formed by the heavier fill monofilaments 38. At spaced intervals along said heavier fill monofilaments 38, fine warp monofilaments 36 pass over the heavier fill monofilaments 38. The weave of the forming belt is such that at least two and up to four (with the belt shown, there are three) of the warp monofilaments 36 pass under each heavier fill monofilament 38 between each warp monofilament 36 that passes over the heavier fill monofilament 38. Therefore, the intervals between said fine wrap monofilaments 36 that pass over the heavier fill monofilaments 38 will usually vary from about two to about four diameters of the fine warp monofilaments 36. In said depressions, warp filaments 36 are interlaced with fine fill monofilaments 34, to provide a relatively tightly closed, but still liquid pervious, zone.

Figure 16:
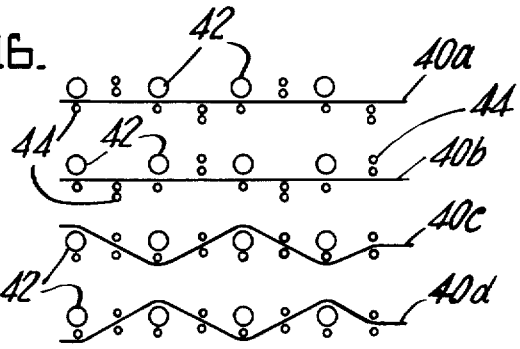
FIGS. 16–18 are schematic cross-sections through four successive warps of the forming belts used in Examples 1, 2, and 3 respectively.

In the Examples, below, three different forming belts were used. Their description is as follows:

Forming Belt A—80 warps ends per inch by 26 picks per inch. Schematic cross-sections through four successive warps 40*a*, 40*b*, 40*c*, 40*d* are shown in FIG. 16. The pattern repeats after four warps. The warps were 0.01 inch polyester monofilaments, and the two different sized filling threads were 0.04 inch 42 and 0.016 inch 44 polyester monofilaments.

Figure 17:
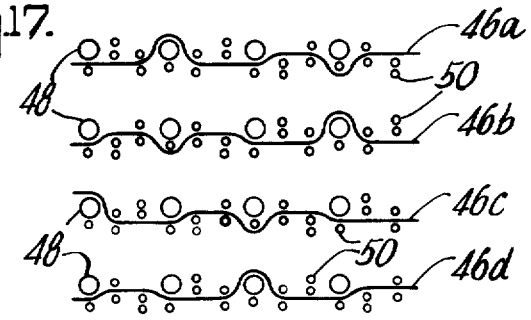

Forming Belt B—(Shown in FIGS. 14 and 15)—80 warp ends per inch by 24 picks per inch. Schematic cross-sections through four successive warps 46*a*, 46*b*, 46*c*, 46*d* are shown in FIG. 17. The pattern repeats after four warps. Warp—0.016 inch polyester monofilaments; fill—0.08 inch nylon 48 and 0.016 inch polyester 50 monofilaments.

Figure 18:
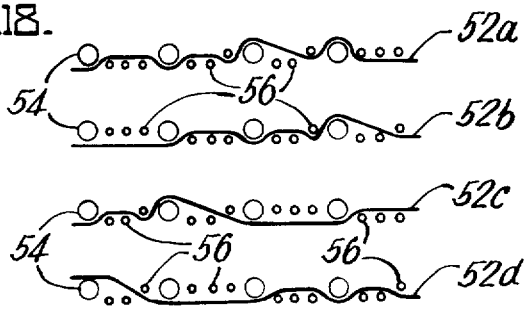
Figure 19:
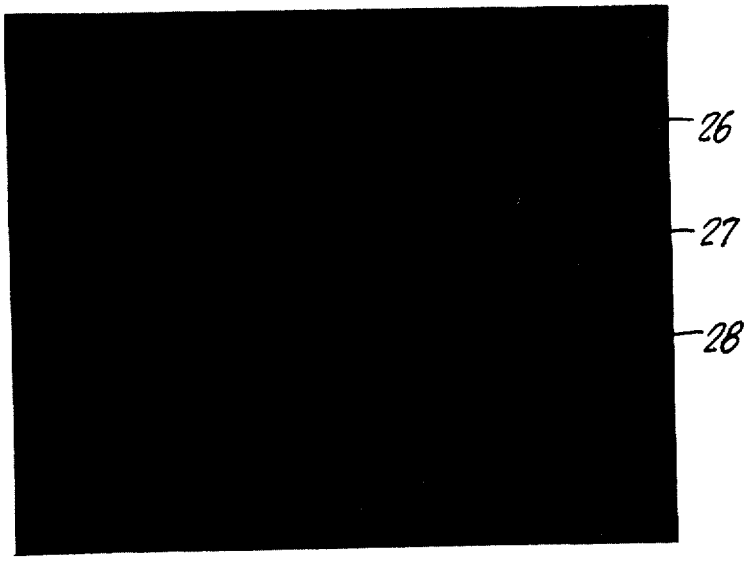
FIGS. 19–22 are photomacrographs taken 10X of the fabric of Example 3(*a*), with the views differing from one another as follows FIG. 19—A view of the top side, illuminated from above.
Figure 20:
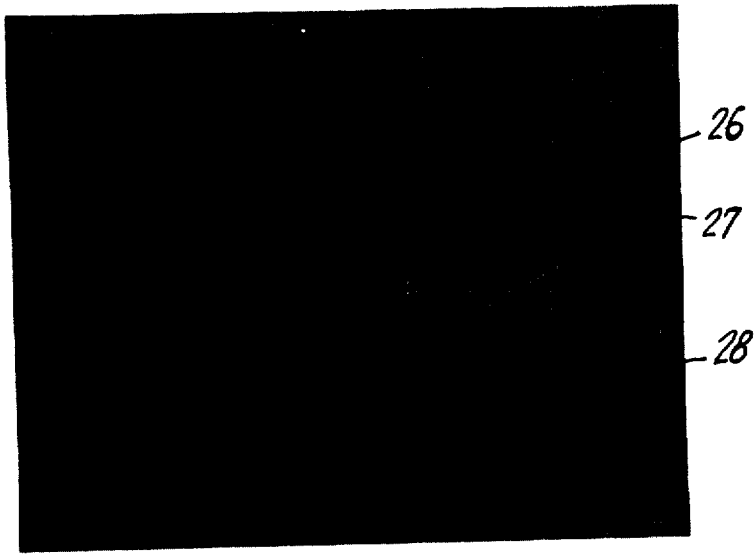
Figure 22:
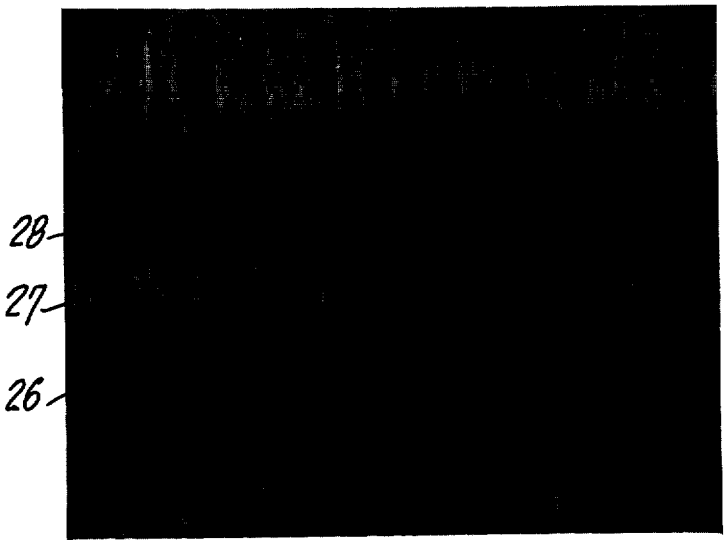
Figure 21:
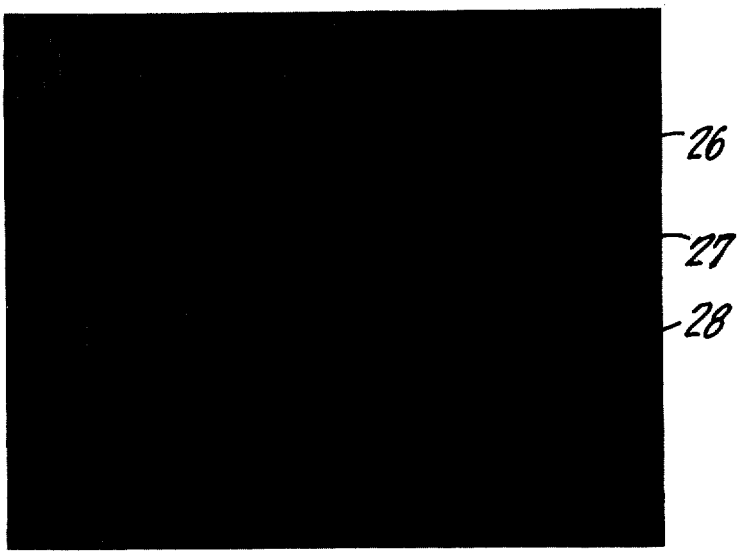
Figure 23:
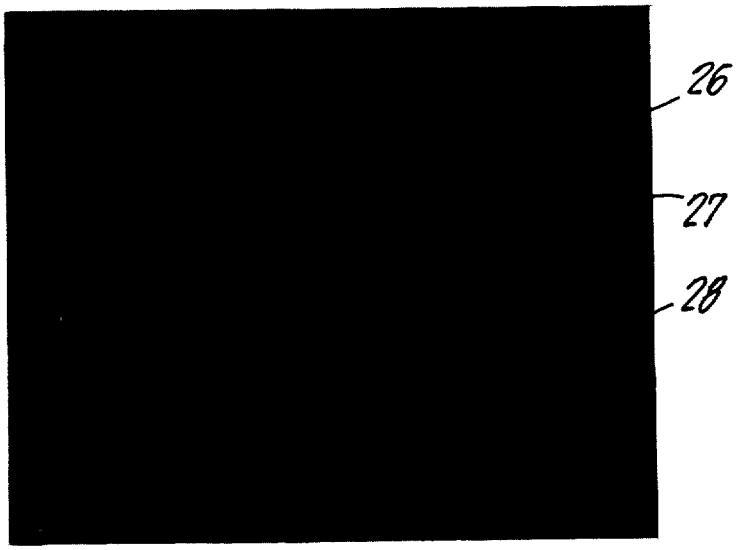
FIGS. 23–26 are photomacrographs taken at 10X of the fabric of Example 3(*b*), with the views differing from one another as follows FIG. 23—A view of the top side, illuminated from above.
Figure 24:
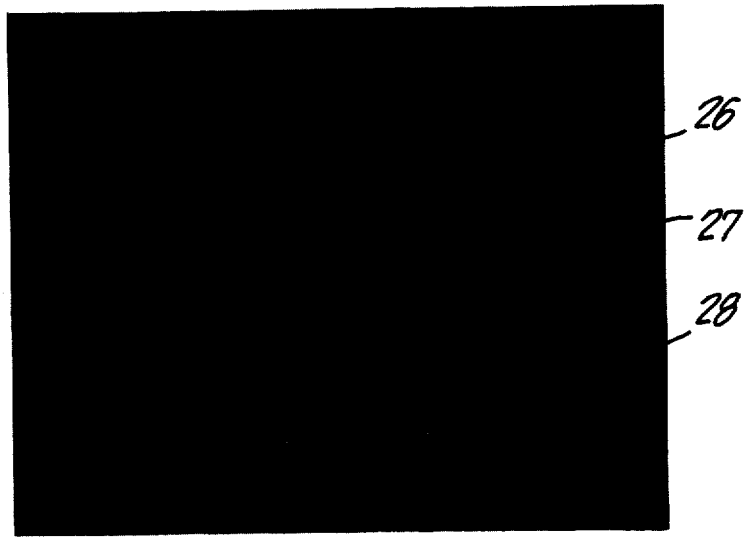
Figure 25:
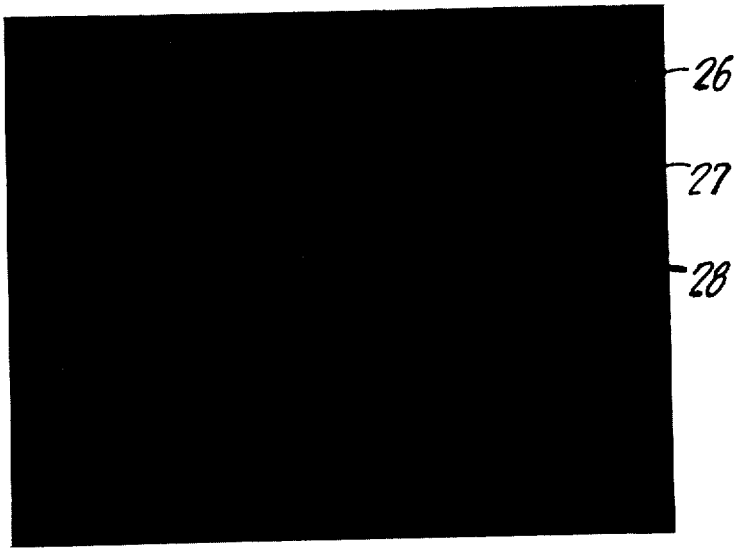
Figure 26:
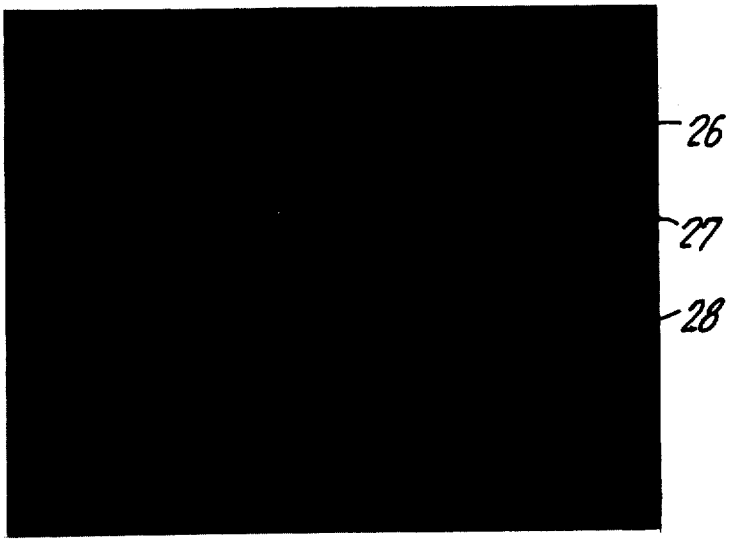
Figure 27:
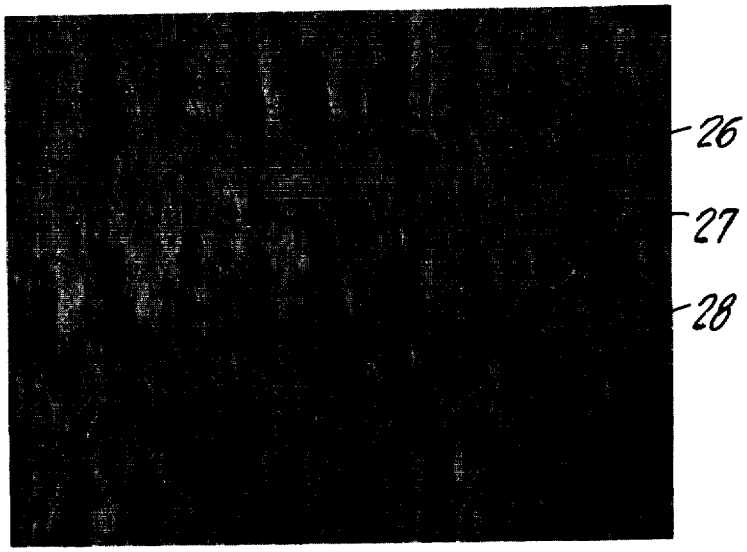
FIGS. 27–30 are photomacrographs taken at 10X of the fabric of Example 3(*c*), with the views differing from one another as follows FIG. 26—A view of the top side, illuminated from above.
Figure 28:
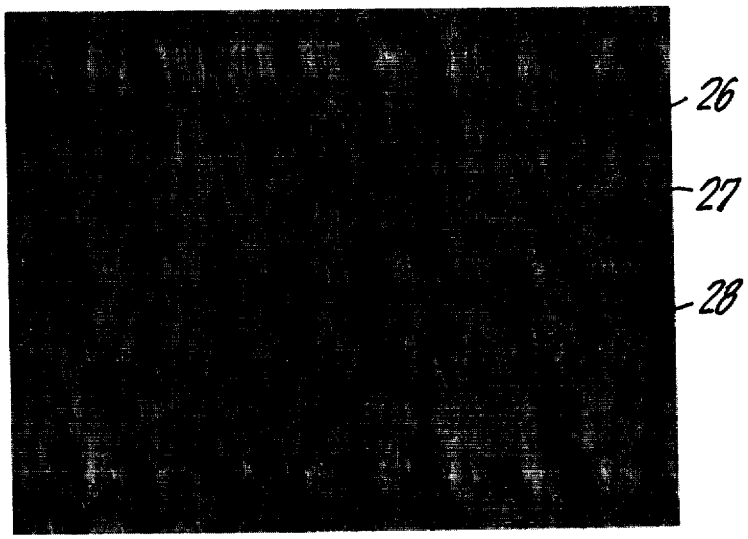
Figure 29:
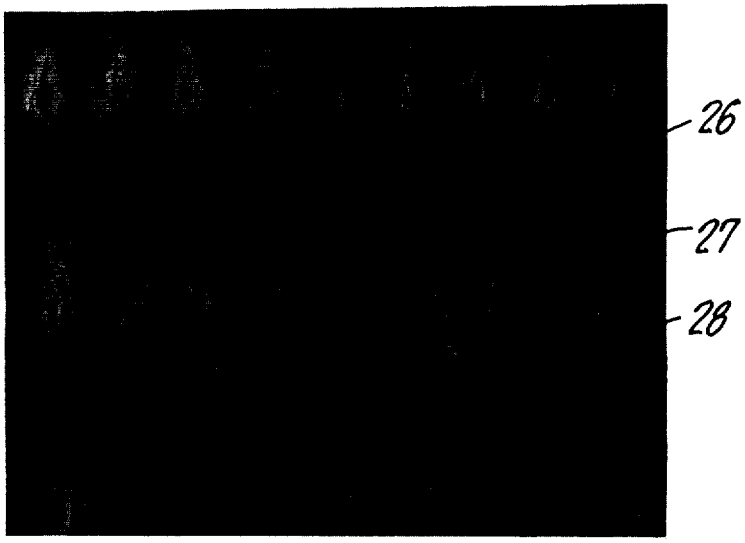
Figure 30:
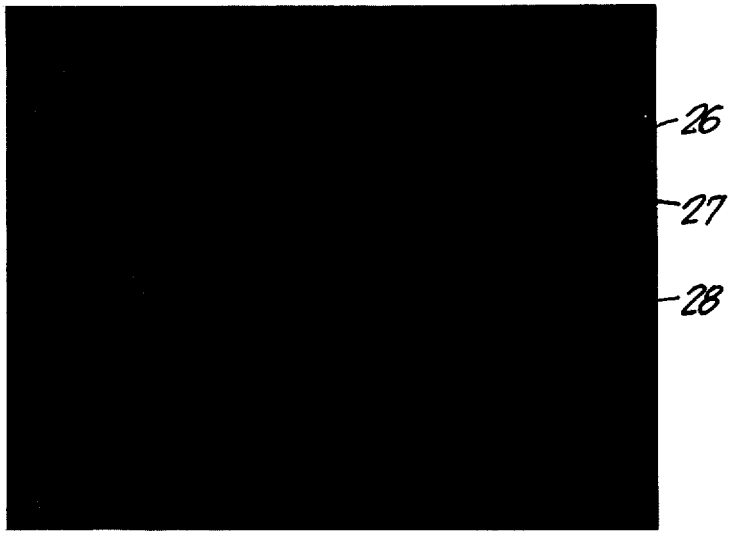

Forming Belt C—60 warp ends per inch by 22 picks per inch. Schematic cross-sections through four successive warps 52*a*, 52*b*, 52*c*, 52*d* are shown in FIG. 18. The pattern repeats after four warps. Warp—0.016 inch polyester monofilaments; fill—0.04 inch 54 and 0.01 inch 56 polyester monofilaments.

EXAMPLE 1

Avtex SN1913 1.5 denier, 1⅛ inch staple rayon was processed through an opener blender and fed to a random air laying unit which deposited a 2-ounce web of random formed fibers on the forming belt. The forming belt used was Forming Belt A. The web was passed under a water weir to wet the fiber and then processed under five manifolds, each manifold containing three orifice strips. The orifice strips contained a row of holes, 50 holes per inch, of 0.005 inch diameter, through which the water jetted. Under the manifolds, the web was exposed to water jets operating at the following pressures:

1st manifold 450 psig
2nd manifold 1000 psig
3rd manifold 1000 psig
4th manifold 1200 psig
5th manifold 1200 psig Under the forming belt, directly under the row of holes in each orifice strip, there was located a series of vacuum slots. Each slot was ¼-inch wide and pulled a vacuum of about 13 to 14 inches of mercury. The entangled web was dewatered and another 2 ounce web of the same rayon was added on top. The entangled web was not removed from the forming belt, but stayed in registry with it. The combined webs were processed under the same conditions as defined above.

The entire process was operated at 10 yards per minute.

The completed entangled fabric was dried over two stacks of steam cans operating at 60 lbs. and 80 lbs. steam, respectively, and was then rolled up.

EXAMPLE 2

This sample was processed from the same material and under the exact same conditions as Example 1. The only difference was the forming belt, which in this example was Forming Belt B.

EXAMPLE 3

Three samples were made using Forming Belt C. The rayon fiber described in Example 1 was used. The equipment described in Example 1 was used, except that only four manifolds were used. The manifold pressures were the following:

1st manifold 450 psig
2nd manifold 800 psig
3rd manifold 1300 psig
4th manifold 1300 psig The line speed was 10 yards per minute. The steam cans were operated at 300° F. The three fabrics differed in grain weight, as follows.

A. 900 grains per square yard.
B. 1300 grains per square yard.
C. 2200 grains per square yard.

Samples A and B were each produced in a single pass. Sample C was produced by sequential entangling of two 1100 grain webs, as described in Example 1. With Samples A and B, the vacuum pulled on the slots beneath the rows of jets was about 7 to 8 inches of mercury. With Sample C, the vacuum was about 13 to 14 inches of mercury.

Figure 8:
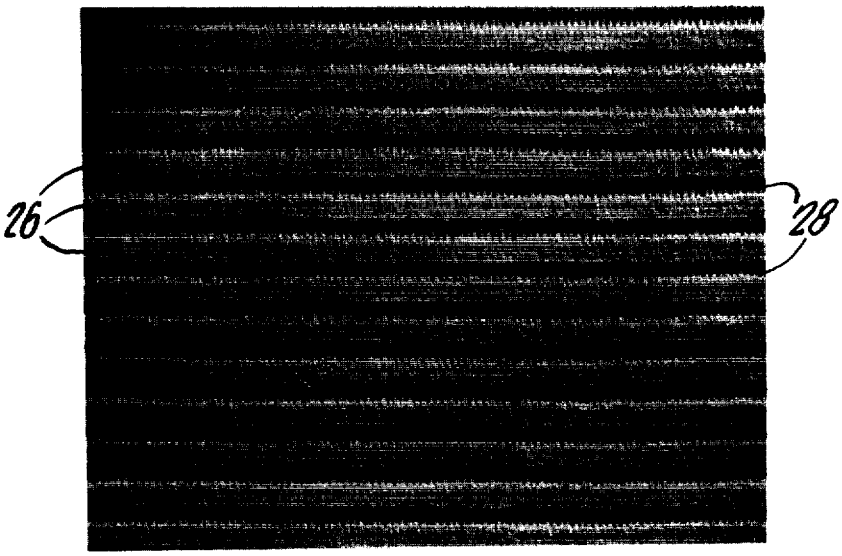
FIG. 8 is a photograph of the fabric of Example 2, the original photograph showing the fabric at about actual size.
Figure 2:
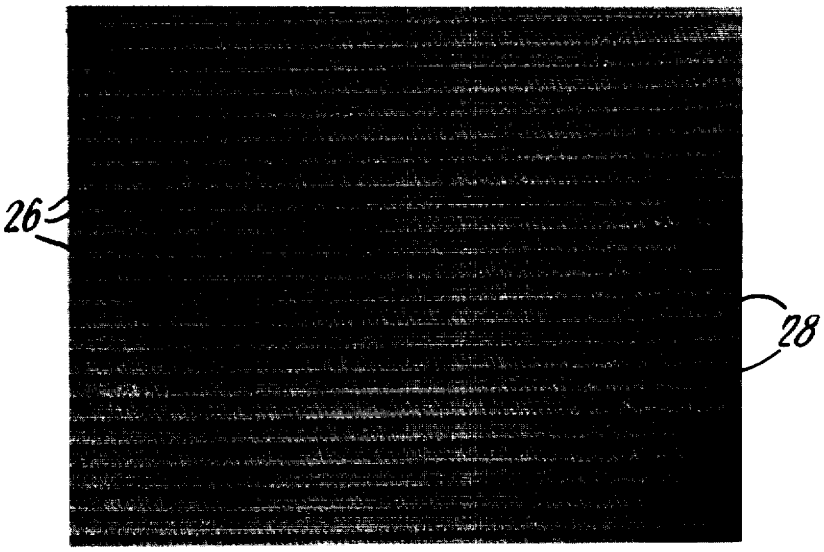
FIG. 2 is a photograph of the fabric of Example 1, the original photograph showing the fabric at about actual size.

The fabrics prepared in Examples 1, 2 and 3 are shown in FIGS. 2–13 and 19–30. Referring first to FIGS. 2 and 8, the repeating pattern of raised, spaced, parallel ribs 26 interconnected by spaced bundles 28 of fibers is clearly visible. Viewed on this macroscopic scale, the ribs are seen to be uniform and substantially non-patterned. (By "substantially non-patterned" is meant that the only departure from a smooth, straight, uniform appearance is the presence of small, inconspicuous surface indentations on the belt side, as are seen in the ribs 26 in FIGS. 2 and 8. The "belt side" is the side of the fabric that is next to the forming belt during the rearrangement/entanglement step.)

The ribs 26 are almost wholly entangled. This can be seen best in FIGS. 6, 7, 12, 13, 19, 20, 23, 24, 27 and 28. That is, unlike the case with the bands in the fabrics of Evans et al. (U.S. Pat. No. 3,498,874), there appears to be no interstitial array of generally parallelized (i.e., unentangled) fibers.

The interconnecting bundles 28 are almost wholly unentangled. This is best seen in FIGS. 4, 7, 10, 22, and 19–30. Adjacent interconnecting bundles 28 and the ribs 26 which they interconnect form apertures 27 that are substantially congruent, that is, the apertures 27 in any given fabric of the invention are all about the same size and shape when viewed macroscopically.

Figure 4:
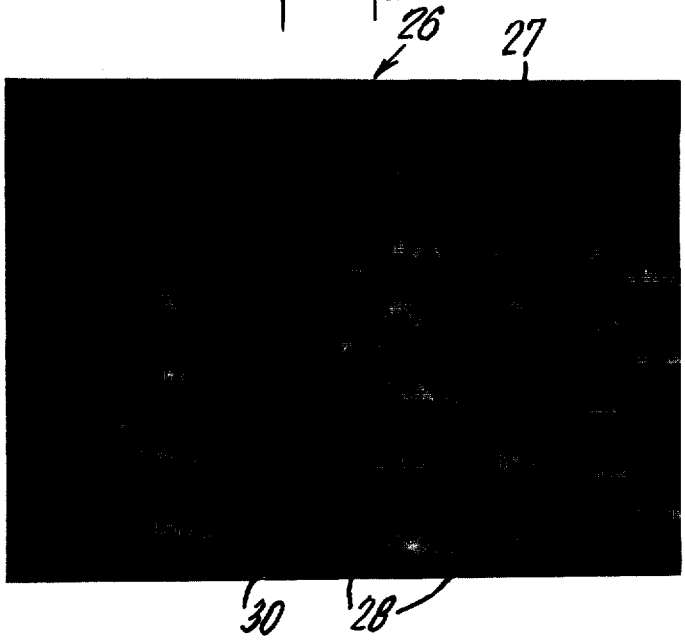
FIGS. 3–7 are photomacrographs of the fabric of FIG. 2, originally taken at about 10X, with the views differing from one another as follows.
Figure 3:
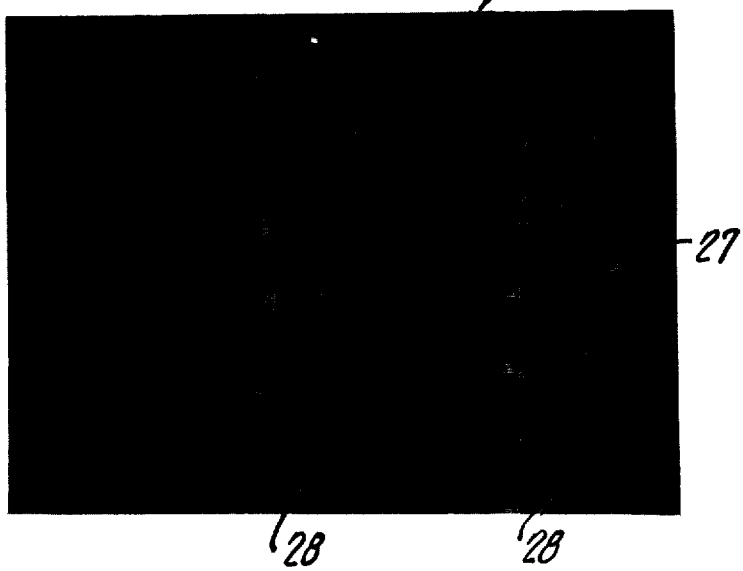
Figure 6:
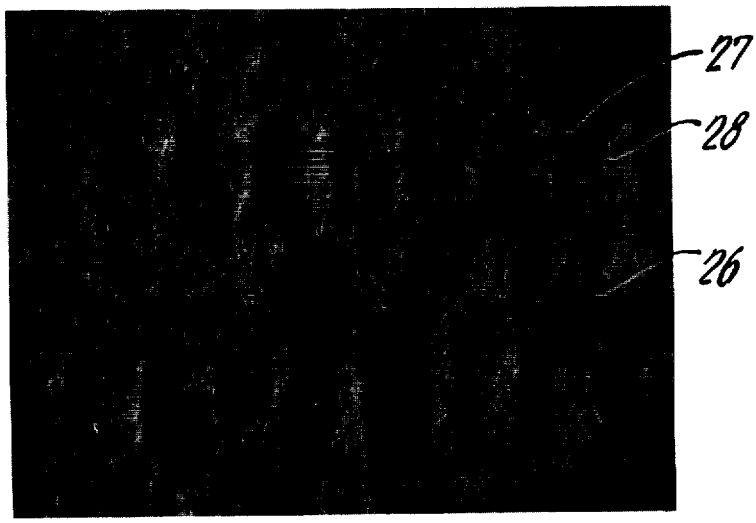
Figure 5:
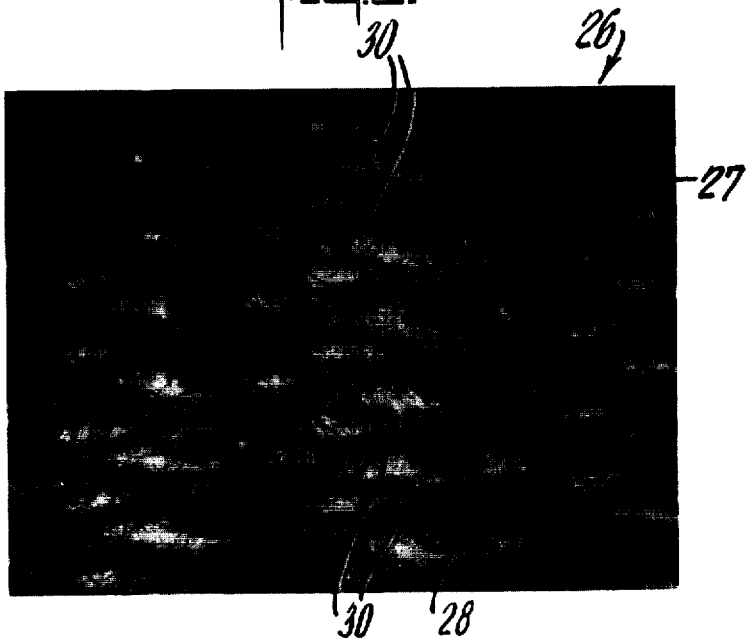
Figure 9:
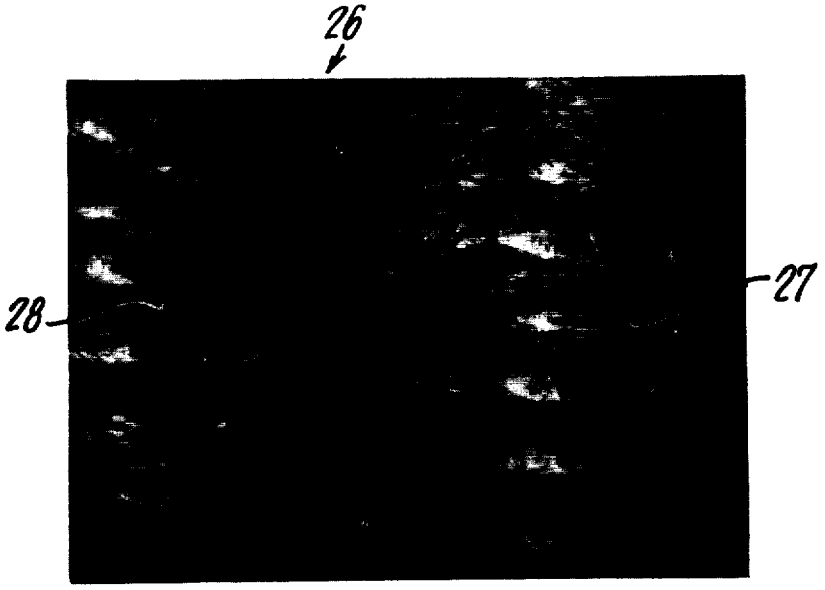
FIGS. 9–13 are photomacrographs of the fabric of FIG. 8, originally taken at about 10X, with the views differing from one another as follows.
Figure 7:
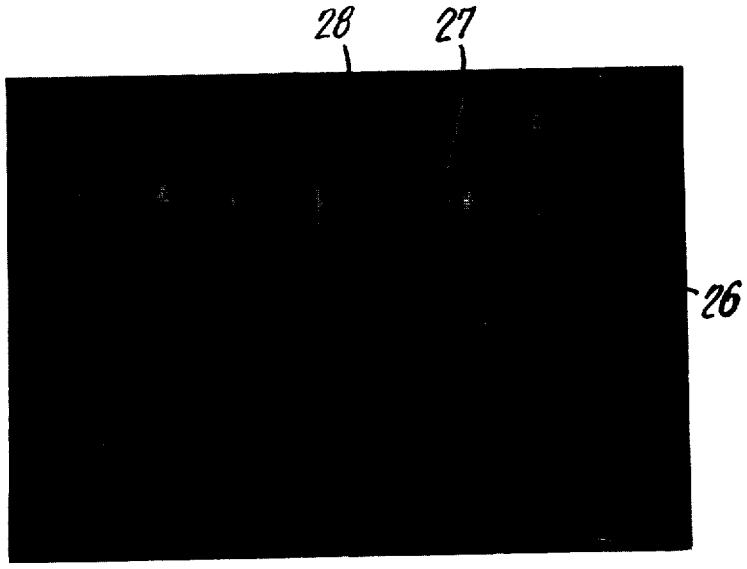
Figure 11:
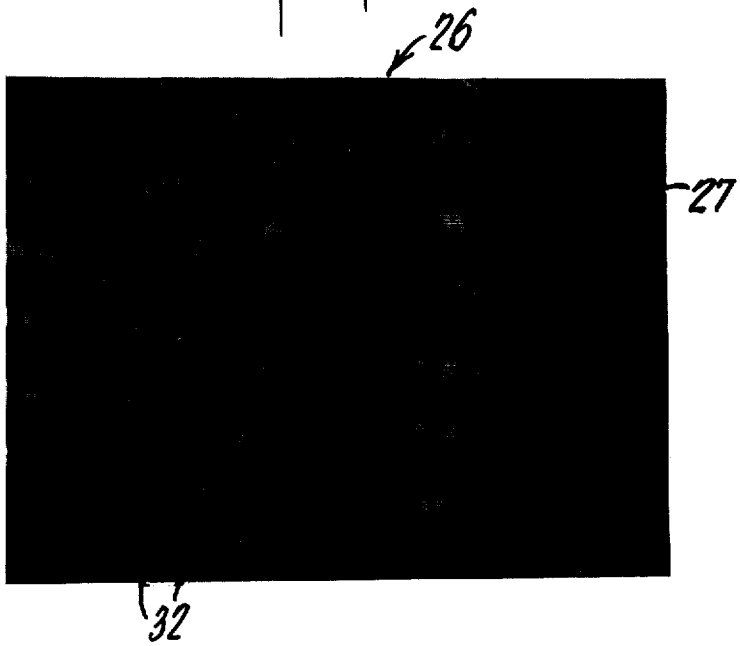
Figure 10:
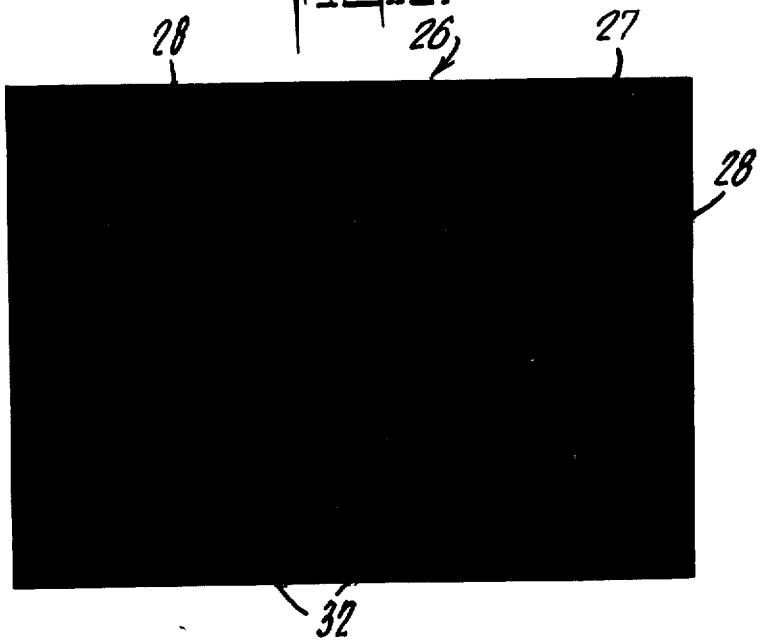
Figure 13:
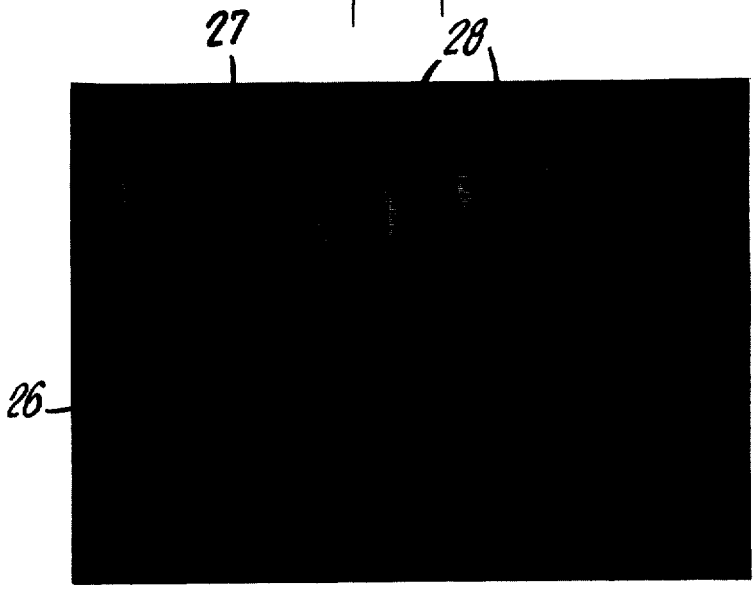
Figure 12:
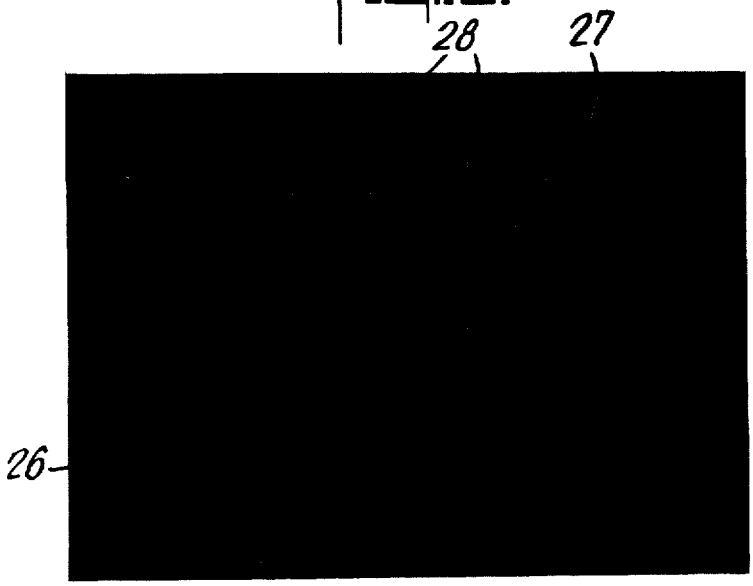

The bands in the fabrics of Evans et al. (U.S. Pat. No. 3,498,874) exhibit a simple zig-zag pattern when viewed by transmitted light. To the extent that a pattern in the ribs is visible when the fabrics of this invention are viewed by transmitted light, such a pattern is much more complex than a simple zig-zag pattern. This is illustrated in FIGS. 4 and 5 as 30, and FIGS. 11 and 12 as 32, and with these two fabrics (Examples 1 and 2), no pattern was visible when viewing the other side.

The interconnecting bundles 28 are formed in the process of the invention in the intervals between the warp monofilaments 36 (see FIG. 14) that pass over the heavier fill monofilaments 38. The jets of liquid 14 (FIG. 1) strike these warp monofilamants 36 and are deflected transversely to first "wash" the fibers into the said intervals. The fibers are then oriented in a direction parallel to the warp monofilaments 36 by the action of the liquid as it is also deflected by the heavier fill monofilaments 38 in a direction generally parallel to the warp monofilaments 36. The spaces between the heavier fill monofilaments 38 are relatively free of significant raised deflecting means. As a result, the ribs 26 which form in these spaces are substantially wholly entangled throughout. This is a point of significant distinction over Evans et al., U.S. Pat. No. 3,498,874, wherein the finer wires that pass over the heavier wires have the effect of deflecting the entangling liquid laterally in the depressions between the heavier wires to cause the formation of Evans et al's "interstitial arrays of generally parallelized fibers." The Evans et al. "zig-zag pattern" of entangled fibers forms in the spaces between said finer wires. With the present invention, the ribs lack this interstitial array of generally parallelized (i.e., unentangled) fibers because of the substantial absence of any significant raised deflecting means in the depressions or spaces between the heavier fill monofilaments 38. Such raised deflecting means would cause the rearranging fibers to "wash over" the means and form parallelized fiber segments in the same way that the bundles 28 are formed over the heavier fill monofilaments 38.

We claim:

1. A nonwoven fabric composed of staple fibers, and having the appearance of apertured, ribbed terry cloth, said fabric being characterized by a repeating pattern of spaced, parallel, raised ribs of entangled staple fibers, which ribs extend in one fabric direction, with the ribs being interconnected by spaced bundles of straight unentangled, substantially parallel staple fiber segments, wherein said bundles are substantially parallel to one another and substantially perpendicular to said ribs, wherein adjacent bundles and the ribs which they interconnect define apertures, and wherein said ribs are substantially wholly entangled throughout and appear uniform and substantially nonpatterned.

2. The fabric of claim 1 wherein said fabric weighs from about 1½ to about 6 ounces per square yard.

3. The fabric of claim 1 or 2 wherein said fabric is made of rayon fibers.

* * * * *